US006739257B1

(12) United States Patent
Velez et al.

(10) Patent No.: US 6,739,257 B1
(45) Date of Patent: May 25, 2004

(54) MEDIA CLAMPING APPARATUS FOR AN EXTERNAL DRUM IMAGING SYSTEM

(75) Inventors: Walter Velez, Bedford, MA (US); Kevin McManus, Rowley, MA (US)

(73) Assignee: Agfa Corporation, Wilmington, DE (US)

( * ) Notice: Subject to any disclaimer, the term of this patent is extended or adjusted under 35 U.S.C. 154(b) by 0 days.

(21) Appl. No.: 10/425,216

(22) Filed: Apr. 29, 2003

(51) Int. Cl.[7] ..... B41F 27/00

(52) U.S. Cl. ..... 101/389.1; 101/378; 101/415.1; 101/463.1

(58) Field of Search ..... 101/378, 382.1, 101/383, 415.1, 477, 389.1, 463.1

(56) References Cited

U.S. PATENT DOCUMENTS 4,138,102 A * 2/1979 Palmer ..... 271/3.2
4,852,490 A 8/1989 McEachern
4,890,553 A 1/1990 Turner
5,575,204 A * 11/1996 Kawai et al. ..... 101/116
6,130,702 A 10/2000 Ganton
6,412,413 B1 7/2002 Tice et al.
6,457,410 B1 10/2002 Zerillo
2003/0183102 A1 * 10/2003 Zerillo ..... 101/389.1

* cited by examiner

*Primary Examiner*—Ren Yan
(74) *Attorney, Agent, or Firm*—John A. Merecki; Robert A. Sabourin

(57) ABSTRACT

An apparatus for clamping the trailing edge of a supply of recording media on the external drum of an imaging system. The trailing edge clamping apparatus includes a plurality of magnetic clamp sections. Each magnetic clamp section includes: a body having a top portion and a pair of legs, wherein a bottom surface of each leg forms a clamping surface of the magnetic clamp section; a plurality of apertures formed in the top portion of the body for receiving a corresponding plurality of lift pads of an actuating system; a set of permanent magnets mounted to an underside of the top portion of the body; and a cover for encapsulating and protecting the set of permanent magnets, wherein the cover includes a raised portion for accommodating the set of permanent magnets, and a pair of flanges for securing the cover to the underside of the top portion of the body.

19 Claims, 7 Drawing Sheets

MEDIA CLAMPING APPARATUS FOR AN EXTERNAL DRUM IMAGING SYSTEM

FIELD OF THE INVENTION

The present invention is in the field of imaging systems. More particularly, the present invention provides an apparatus for clamping the trailing edge of a supply of recording media, such as a printing plate, on the external drum of an imaging system.

BACKGROUND OF THE INVENTION

In external drum imaging systems, a movable optical carriage is commonly used to displace an image recording source in a slow scan direction while a cylindrical drum, having recording media mounted on an external surface thereof, is rotated with respect to the image recording source. The drum rotation causes the recording media to advance past the image recording source along a fast scan direction that is substantially perpendicular to the slow scan direction.

The image recording source may include an optical system for generating at least one imaging beam that is scanned across the surface of the recording media. Each imaging beam may be separately modulated according to a digital information signal representing data corresponding to the image to be recorded.

The recording media to be imaged by an external drum imaging system is commonly supplied in discrete, flexible sheets, hereinafter collectively referred to as "printing plates." Each printing plate may comprise one or more layers supported by a support substrate, which for many printing plates is a plano-graphic aluminum sheet. Other layers may include one or more image recording (i.e., "imageable") layers such as a photosensitive, radiation sensitive, or thermally sensitive layer, or other chemically or physically alterable layers. Printing plates that are supported by a polyester support substrate are also known and can be used in the present invention. Printing plates are available in a wide variety of sizes, typically ranging, e.g., from 9"×12", or smaller, to 58"×80", or larger.

A cassette is often used to supply a plurality of unexposed printing plates to an external drum imaging system. The printing plates are normally supplied in stacks of ten to one hundred, depending upon plate thickness, and are stored in the cassette. A plate manager may be used to automatically and selectively unload and feed a printing plate from a plurality of different cassettes to the external drum imaging system for imaging.

Many clamping systems are available for holding the trailing edge of a printing plate on the external drum of an external drum imaging system. One commonly used type of clamping system, for example, employs a plurality of magnets to hold the trailing edge of a printing plate in place. An example of a magnetic trailing edge clamping mechanism is disclosed in U.S. Pat. No. 6,412,413, incorporated herein by reference. Although this type of trailing edge clamping mechanism is effective, it has several drawbacks. For instance, a magnet of the trailing edge clamping mechanism may break apart from impact loads during normal operational conditions. It this should occur, small pieces of the magnet may adhere to the surface of the external drum. Since this may adversely affect the quality of the imaging provided by the imaging system, the external drum must be carefully cleaned to ensure that all pieces of the broken magnet have been removed. The trailing edge clamping system must also be repaired. This requires that the external drum imaging system be shut down and serviced by a technician, which reduces the throughput of the imaging system (e.g., the number of plates/hour that can be imaged by the system).

SUMMARY OF THE INVENTION

The present invention provides an apparatus and method for clamping the trailing edge of a printing plate on the external drum of an imaging system.

Generally, the present invention provides a trailing edge clamping mechanism for securing a trailing end of a printing plate on an external drum of an imaging system, comprising:

- a plurality of magnetic clamp sections, wherein each magnetic clamp section includes:
  - a body having a top portion and a pair of legs, wherein a bottom surface of each leg forms a clamping surface of the magnetic clamp section;
  - a plurality of apertures formed in the top portion of the body for receiving a corresponding plurality of lift pads of an actuating system;
  - a set of permanent magnets mounted to an underside of the top portion of the body; and
  - a cover for encapsulating and protecting the set of permanent magnets, wherein the cover includes a raised portion for accommodating the set of permanent magnets, and
- a pair of flanges for securing the cover to the underside of the top portion of the body.

The present invention further provides an imaging system comprising:

- an external drum for supporting a printing plate;
- a system for recording image data onto the printing plate;
- a leading edge clamping apparatus for clamping a leading edge of the printing plate on the external drum; and
- a trailing edge clamping apparatus for clamping a trailing edge of the printing plate on the external drum, wherein the trailing edge clamping apparatus includes a plurality of magnetic clamp sections, and wherein each magnetic clamp section includes:
  - a body having a top portion and a pair of legs, wherein a bottom surface of each leg forms a clamping surface of the magnetic clamp section;
  - a plurality of apertures formed in the top portion of the body for receiving a corresponding plurality of lift pads of an actuating system;
  - a set of permanent magnets mounted to an underside of the top portion of the body; and
  - a cover for encapsulating and protecting the set of permanent magnets, wherein the cover includes a raised portion for accommodating the set of permanent magnets, and a pair of flanges for securing the cover to the underside of the top portion of the body.

BRIEF DESCRIPTION OF THE DRAWINGS

The features of the present invention will best be understood from a detailed description of the invention and embodiments thereof selected for the purpose of illustration and shown in the accompanying drawings in which.

DETAILED DESCRIPTION OF THE INVENTION

Figure 1:
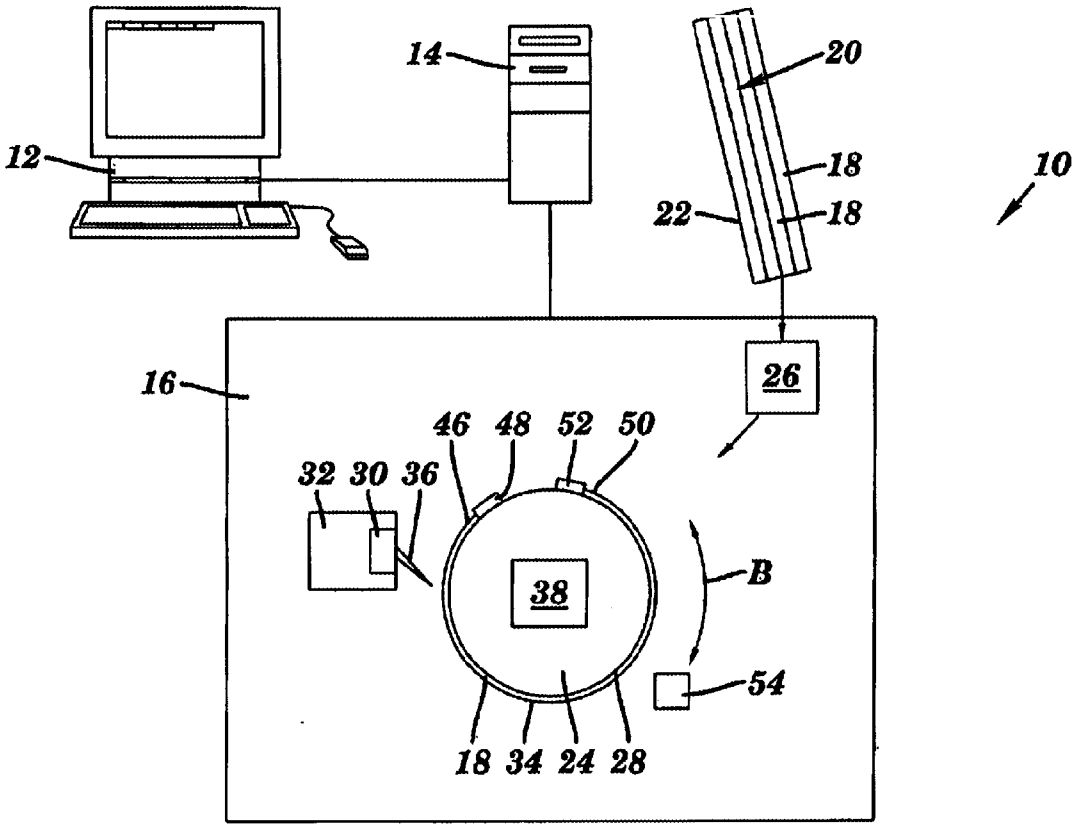
FIG. 1 illustrates an external drum imaging system for recording images onto a printing plate.

The features of the present invention are illustrated in detail in the accompanying drawings, wherein like reference numerals refer to like elements throughout the drawings. Although the drawings are intended to illustrate the present invention, the drawings are not necessarily drawn to scale.

An example of an external drum imaging system 10 is illustrated in FIG. 1. In this example, the imaging system 10 comprises an external drum platesetter configured to record digital data onto a printing plate 18. Although described below with regard to an external drum platesetter, the trailing edge clamping apparatus of the present invention may be used in conjunction with a wide variety of other types of external drum, internal drum, or flatbed imaging systems, including imagesetters and the like, without departing from the intended scope of the present invention. Further, the trailing edge clamping apparatus of the present invention may be used to clamp an unexposed printing plate on the plate cylinder of a printing press having an "on-press" imaging system. In its broadest sense, the trailing edge clamping apparatus of the present invention may be used to clamp a sheet-like material to any type of cylindrical drum.

The imaging system 10 generally includes a front end computer or workstation 12 for the design, layout, editing, and/or processing of digital files representing pages to be printed, a raster image processor (RIP) 14 for processing the digital pages to provide rasterized page data (e.g., rasterized digital files) for driving an image recorder, and an image recorder or engine, such as an external drum platesetter 16, for recording the rasterized digital files onto a printing plate 18.

A stack 20 of printing plates 18 is commonly supplied in a cassette 22. A printing plate 18 is picked off of the stack 20 and subsequently mounted on an external drum 24 of the external drum platesetter 16 by an autoloading system 26. A plate manager (not shown) may be used to automatically and selectively unload and feed a printing plate from a plurality of different cassettes to the external drum imaging system for imaging.

Figure 2:
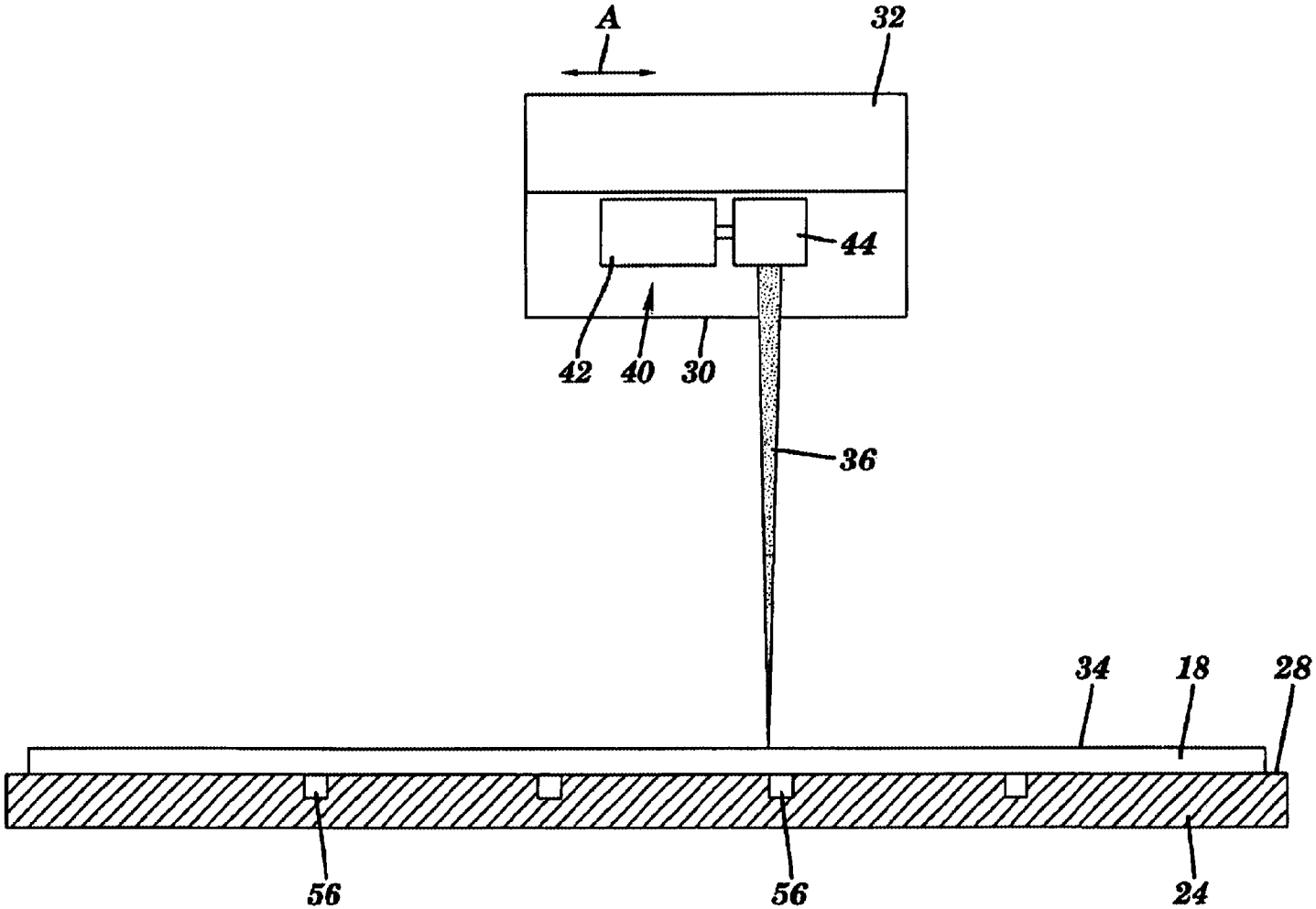
FIG. 2 illustrates an example of an imaging system including a movable optical carriage and scanning system, usable in the external drum imaging system of FIG. 1.

The external drum platesetter 16 includes an external drum 24 having a cylindrical media support surface 28 for supporting a printing plate 18 during imaging. The external drum platesetter 16 further includes a scanning system 30, coupled to a movable carriage 32, for recording digital data onto the imaging surface 34 of the printing plate 18 using at least one imaging beam 36. An example of a scanning system 30 is illustrated in FIG. 2. In particular, the scanning system 30 is displaced by the movable carriage 32 in a slow scan axial direction (directional arrow A) along the length of the rotating external drum 24 to expose the printing plate 18 in a line-wise manner when a single beam is used or in a section-wise manner for multiple beams. Other types of imaging systems may also be used in the present invention.

The external drum 24 is rotated by a drive system 38 in a clockwise or counterclockwise direction as indicated by directional arrow B in FIG. 1. Typically, the drive system 38 rotates the external drum 24 at a rate of about 100–1000 rpm. As further illustrated in FIG. 2, the scanning system 30 includes a system 40 for generating the imaging beam or beams 36. The system 40 comprises a light or radiation source 42 for producing the imaging beam or beams 36 (illustrated for simplicity as a single beam), and an optical system 44 positioned between the radiation source 42 and the media support surface 28 for focusing the imaging beam or beams 36 onto the printing plate 18. It should be noted, however, that the system 40 described above is only one of many possible different types of scanning systems that may be used to record image data on the printing plate 18.

In the external drum imaging system 10 shown in FIG. 1, the leading edge 46 of the printing plate 18 is held in position against the media support surface 28 of the external drum 24 by a leading edge clamping mechanism 48. Similarly, the trailing edge 50 of the printing plate 18 is held in position against the media support surface 28 of the external drum 24 by a trailing edge clamping mechanism 52. An example of a suitable leading edge clamping mechanism 48 is detailed in U.S. Pat. No. 6,412,413, incorporated herein by reference. Many other known systems may also be used to clamp the leading edge 46 of the printing plate 18 against the media support surface 28 of the external drum 24. The leading edge clamping mechanism 48 and the trailing edge clamping mechanism 52 provide a tangential friction force between the printing plate 18 and the media support surface 28 of the external drum 24 that is sufficient to resist the tendency of the edges of the printing plate 18 to pull out of the clamping mechanisms 48, 52, at a high drum rotational speed.

A vacuum source 54 may be used to draw a vacuum through an arrangement of ports and vacuum grooves 56 (FIG. 2) to hold the printing plate 18 against the media support surface 28 of the external drum 24. The vacuum source 54 may also supply a vacuum to the autoloading system 26 that is configured to remove or "pick" the too printing plate 18 from the stack 20 of printing plates. A registration system comprising, for example, a set of registration pins on the external drum 24, and a plate edge detection system (not shown), may be used to accurately and repeatably position and locate each printing plate 18 on the external drum 24.

An embodiment of a trailing edge clamping mechanism 100 in accordance with the present invention is illustrated in FIGS. 3–8.

Figure 3:
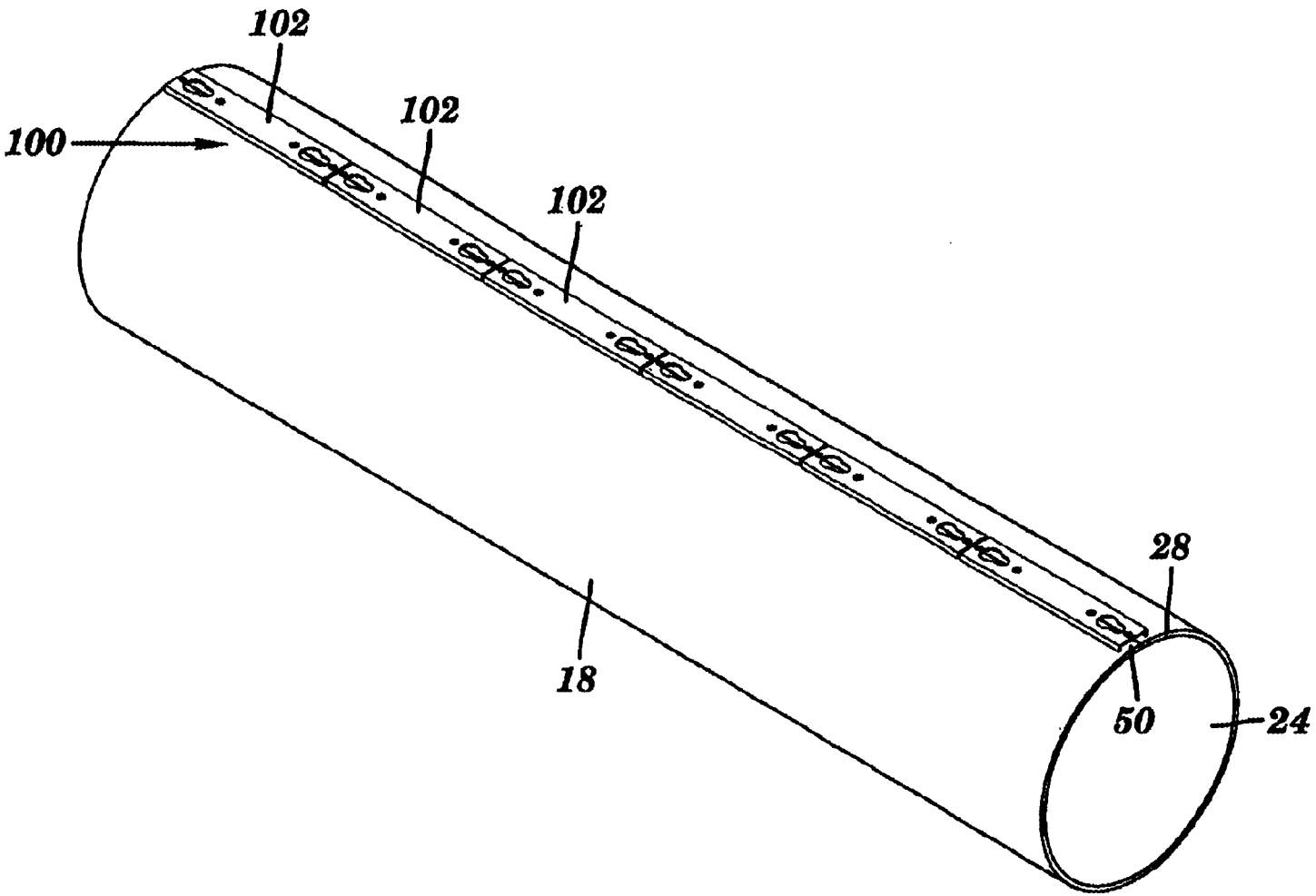
FIG. 3 is a perspective view of an external drum including a trailing edge clamping mechanism in accordance with an embodiment of the present invention.
Figure 4:
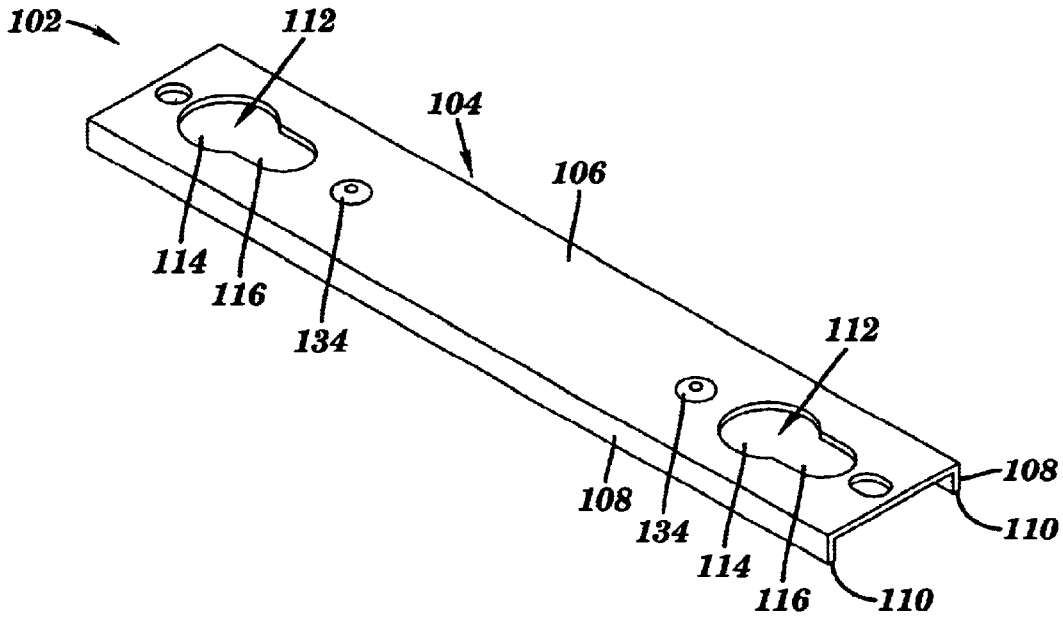
FIG. 4 is a top perspective view of one section of the trailing edge clamping mechanism of FIG. 3.

As shown in FIG. 3, the trailing edge clamping mechanism 100 includes a plurality of magnetic clamp sections 102 which collectively extend axially across a substantial portion of the width of the external drum 24. The length of the trailing edge clamping mechanism 100 is generally greater than the width of the largest printing plate 18 that may be imaged on the external drum 24. The magnetic clamp sections 102 of the trailing edge clamping mechanism 100 may be collectively or individually positioned against, and removed from, the media support surface 28 of the external drum 24 by an actuating system (not shown) comprising at least one actuator.

The external drum 24 is formed of a material such as steel or a ferromagnetic alloy. Each magnetic clamp section 102 includes one or more magnets (FIGS. 6, 8) for securing the section 102 on the external drum 24. In FIG. 3, for example, a plurality of the magnetic clamp sections 102 are shown positioned on the external drum 24 over the trailing edge 50 of the printing plate 18. The magnetic attraction of the plurality of the magnetic clamp sections 102 is sufficient to hold the trailing edge 50 of the printing plate 18 in position on the media support surface 28 of the external drum 24 during imaging.

The structure of a magnetic clamp section 102 is shown in greater detail in FIGS. 4–8.

As shown in FIGS. 4–8, the magnetic clamp section 102 includes a body 104 having a top portion 106 and a pair of legs 108. The bottom surfaces 110 of the legs 108 form the clamping surfaces of the magnetic clamp section 102. Although shown as being flat, the bottom surface 110 of each leg 108 has been rounded to remove any sharp edges that may potentially damage the surface of a printing plate. The magnetic clamp section 102 may be formed from steel or any other suitable material. For example, the magnetic clamp section 102 can be formed of a single piece of cold rolled 1018–1020 14 GA. (0.075" thick) steel.

Figure 9:
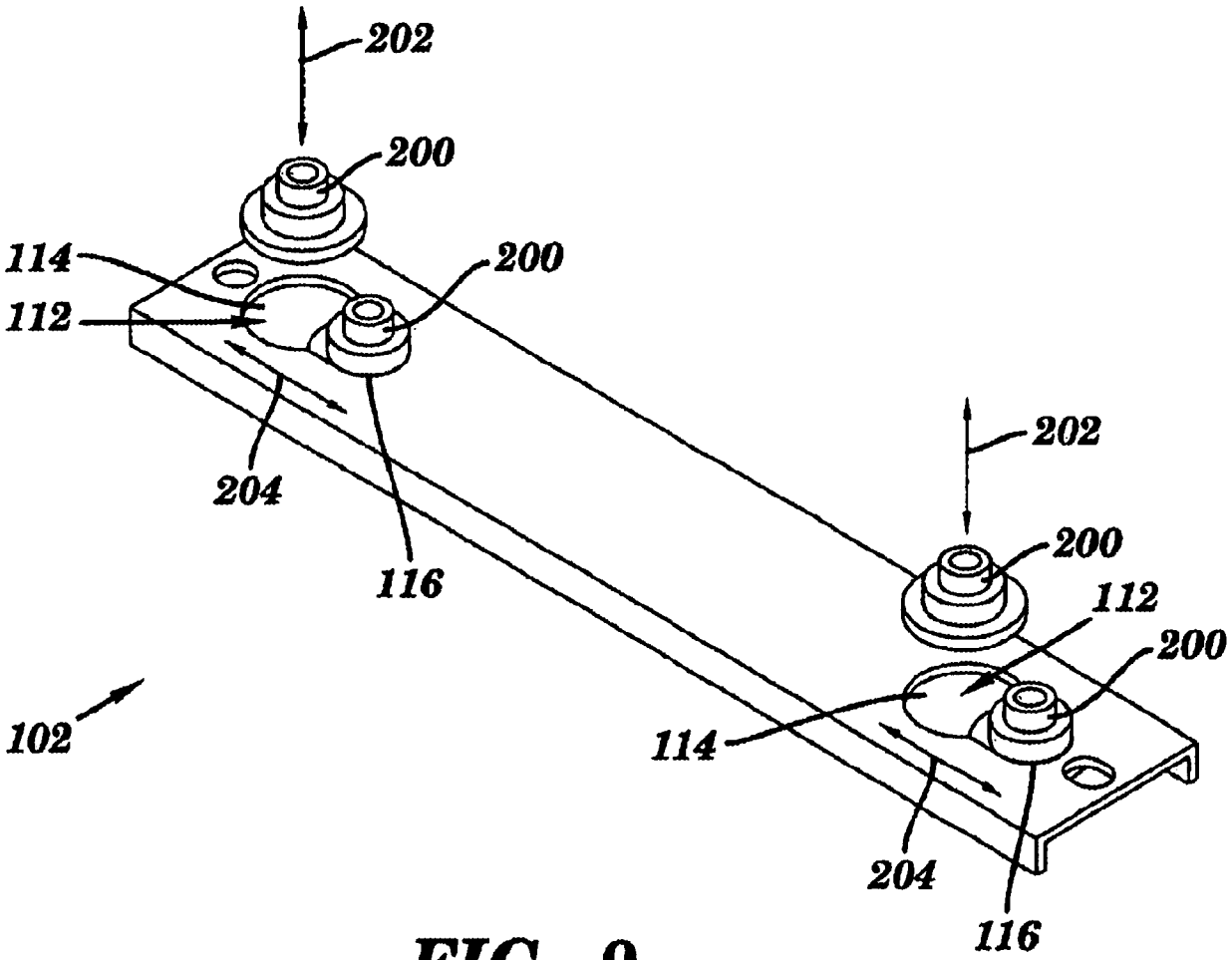
FIG. 9 illustrates the operation of the lift pads of an actuating system.

A plurality of apertures 112 are formed in the top portion 106 of the body 104. Each aperture 112 includes a circular area 114 and an oval area 116. As shown in FIG. 9, the lift pads 200 of an actuating system (not shown) are removably inserted into the apertures 112 to position the magnetic clamp section 102 against, and to remove the magnetic clamp section 102 from, the media support surface 28 of the external drum 24. In particular, the lift pads 200 are designed to be inserted/removed through the circular area 114 of each aperture 112 as indicated by directional arrows 202, and are designed to be displaced sideways into/out of the oval areas 116 to engage/disengage the magnetic clamp section 102 as indicated by directional arrows 204.

Figure 6:
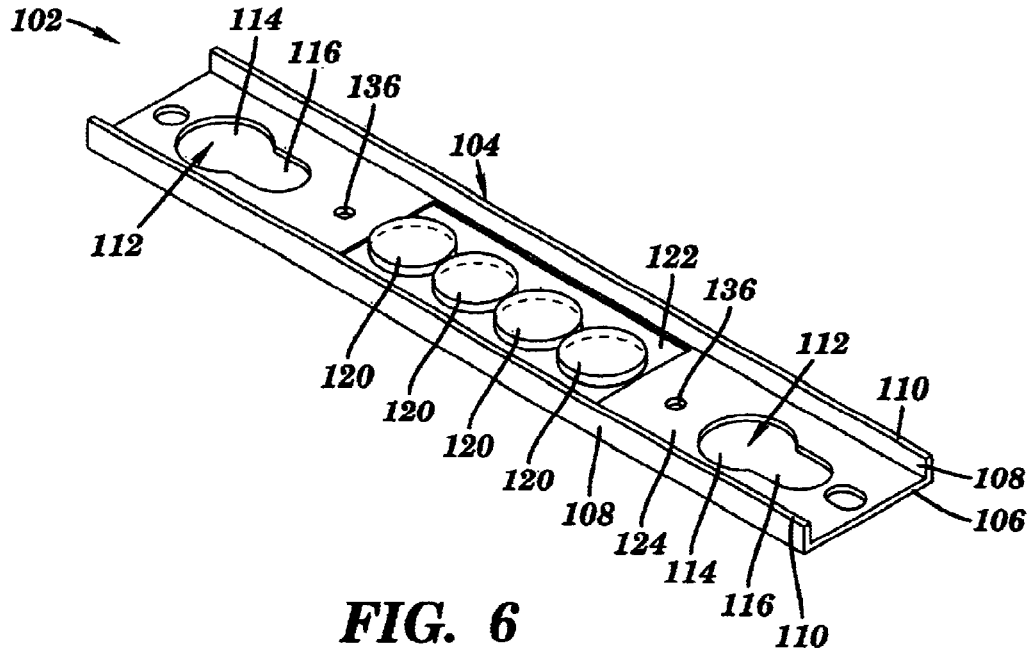
FIG. 6 illustrates an arrangement of magnets used in the trailing edge clamping mechanism.
Figure 8:
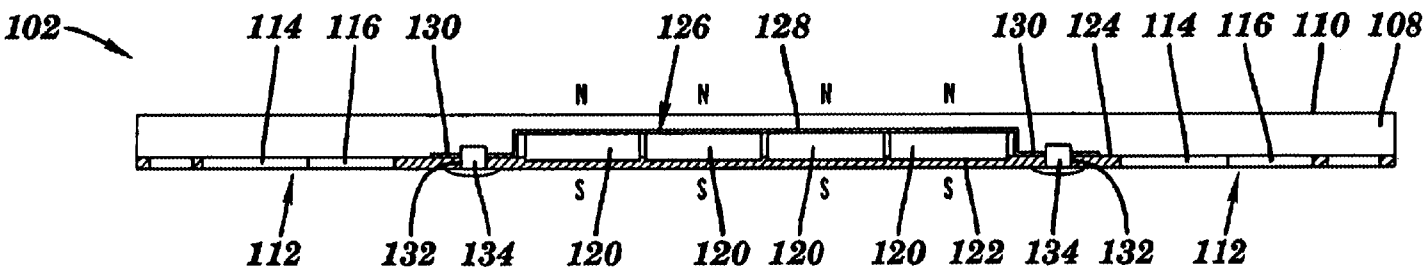
FIG. 8 is a cross-sectional view of one section of the trailing edge clamping mechanism taken along line 8—8 of FIG. 7.

As shown in FIGS. 6 and 8, at least one permanent magnet 120 is positioned within a recess 122 formed in the underside 124 of the top portion 106 of the body 104. Each magnet 120 is secured within the recess 122 using an adhesive or other suitable method.

The type/number of magnets 120 that are used is application specific, and must be chosen such that the clamping force provided by the plurality of the magnetic clamp sections 102 forming the trailing edge clamping mechanism 100 is sufficient to prevent a printing plate from lifting off of the drum during rotation and imaging. For example, the magnetic force provided by each clamp section 102 may be in the range of about 19 to 30 lbs. In the disclosed embodiment of the present invention, for example, four permanent neodymium-iron-boron (Nd-Fe-B) magnets 120 are used.

A cover 126 is provided to encapsulate and protect the magnets 120 from damage during the operation of the trailing edge clamping mechanism 100. The cover 126 includes a raised portion 128 for accommodating the magnets 120, and a pair of opposing flanges 130 for securing the cover 126 to the underside 124 of the top portion 106 of the body 104. As shown in FIG. 8, the raised portion 128 of the cover 126 does not extend beyond the bottom surfaces 110 of the legs 108 that form the clamping surfaces of the magnetic clamp section 102. As such, the cover 126 does not interfere with the clamping function of the legs 108.

In the disclosed embodiment of the present invention, 0.015" stainless steel is used to form the cover 126. Other materials capable of covering and protecting the magnets 120 may also be used to form the cover 126 without departing from the scope of the present invention.

Figure 5:
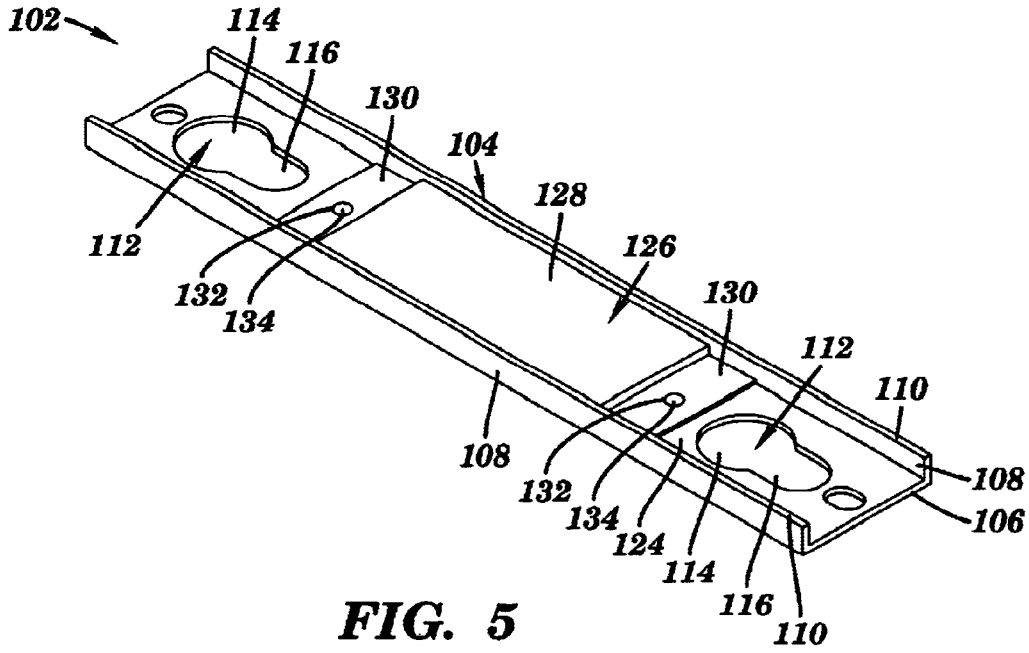
FIG. 5 is a bottom perspective view of one section of the trailing edge clamping mechanism.
Figure 7:
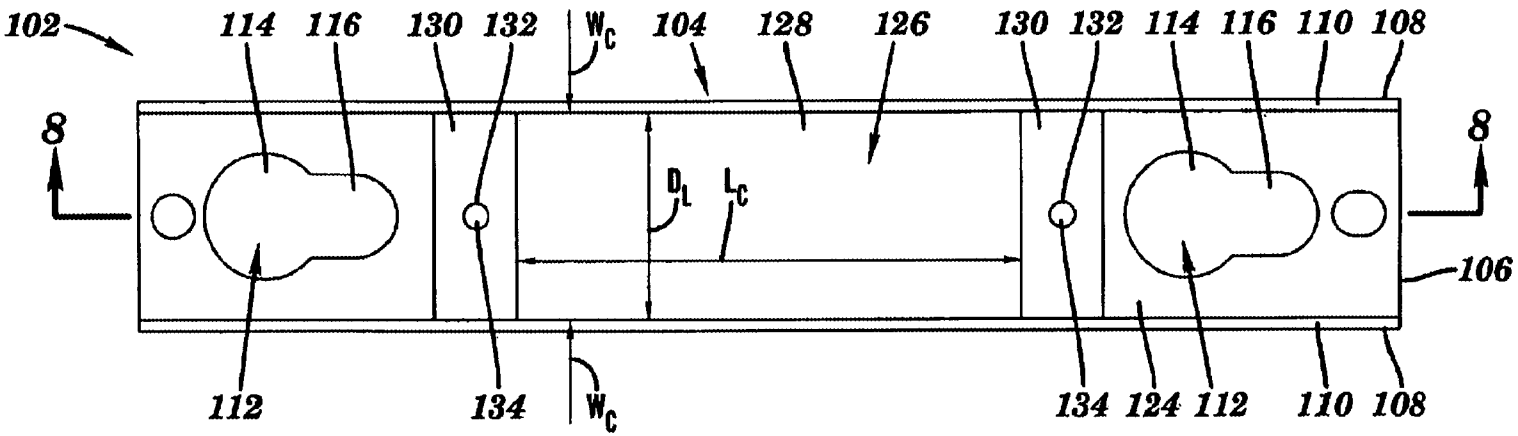
FIG. 7 is bottom plan view of one section of the trailing edge clamping mechanism.

As can be seen in FIGS. 5, 7, and 8, the magnets 120 are completely enclosed by the cover 126. In particular, as shown in FIG. 7, the width $W_C$ of the cover 126 is chosen to be substantially equal to the distance $D_L$ between the legs 108 of body 104, and the length $L_C$ of the raised portion 128 of the cover 126 is chosen to be at least as long as the configuration of magnets 120.

The cover 126 is attached to the underside 124 of the top portion 106 of the body 104 using the pair of opposing flanges 130. In the illustrated embodiment of the present invention, for example, an opening 132 is formed in each flange 130 and rivets 134 are used to secure the cover to the underside 124 of the top portion 106 of the body 104 via the openings 132. Each rivet 134 extends through a flange opening 132 and a corresponding opening 136 formed in the top portion 106 of the body 104. Other known attachment techniques/hardware may also be used to attach the cover 126 to the underside 124 of the top portion 106 of the body 104.

The foregoing description of the present invention has been presented for purposes of illustration and description. It is not intended to be exhaustive or to limit the invention to the precise form disclosed, and many modifications and variations are possible in light of the above teaching. Such modifications and variations that may be apparent to a person skilled in the art are intended to be included within the scope of this invention.

What is claimed is:

1. A trailing edge clamping mechanism for securing a trailing end of a printing plate on an external drum of an imaging system, comprising:

a plurality of magnetic clamp sections, wherein each magnetic clamp section includes:

a body having a top portion and a pair of legs, wherein a bottom surface of each leg forms a clamping surface of the magnetic clamp section;

a plurality of apertures formed in the top portion of the body for receiving a corresponding plurality of lift pads of an actuating system;

a set of permanent magnets mounted to an underside of the top portion of the body; and a cover for encapsulating and protecting the set of permanent magnets, wherein the cover includes a raised portion for accommodating the set of permanent magnets, and a pair of flanges for securing the cover to the underside of the top portion of the body.

2. The trailing edge clamping mechanism of claim 1, wherein the cover completely covers the set of permanent magnets.

3. The trailing edge clamping mechanism of claim 1, wherein the cover has a width that is substantially equal to a distance between the legs of the body.

4. The trailing edge clamping mechanism of claim 1, wherein the set of permanent magnets are positioned within a recess formed in the underside of the top portion of the body.

5. The trailing edge clamping mechanism of claim 1, wherein the set of permanent magnets comprise neodymium-iron-boron magnets.

6. The trailing edge clamping mechanism of claim 1, wherein the set of permanent magnets provides a clamping force against a surface of the external drum.

7. The trailing edge clamping mechanism of claim 1, wherein each aperture includes a circular area and an oval area.

8. The trailing edge clamping mechanism of claim 7, wherein the lift pads of an actuating system are configured to be inserted and removed through the circular area and displaced sideways into and out of the oval areas.

9. The trailing edge clamping mechanism of claim 1, wherein the cover comprises stainless steel.

10. An imaging system comprising:

an external drum for supporting a printing plate;

a system for recording image data onto the printing plate;

a leading edge clamping apparatus for clamping a leading edge of the printing plate on the external drum; and a trailing edge clamping apparatus for clamping a trailing edge of the printing plate on the external drum, wherein the trailing edge clamping apparatus includes a plurality of magnetic clamp sections, and wherein each magnetic clamp section includes:

a body having a top portion and a pair of legs, wherein a bottom surface of each leg forms a clamping surface of the magnetic clamp section;

a plurality of apertures formed in the top portion of the body for receiving a corresponding plurality of lift pads of an actuating system;

a set of permanent magnets mounted to an underside of the top portion of the body; and a cover for encapsulating and protecting the set of permanent magnets, wherein the cover includes a raised portion for accommodating the set of permanent magnets, and a pair of flanges for securing the cover to the underside of the top portion of the body.

11. The imaging system of claim 10, wherein the cover completely covers the set of permanent magnets.

12. The imaging system of claim 10, wherein the cover has a width that is substantially equal to a distance between the legs of the body.

13. The imaging system of claim 10, wherein the set of permanent magnets are positioned within a recess formed in the underside of the top portion of the body.

14. The imaging system of claim 10, wherein the set of permanent magnets comprise neodymium-iron-boron magnets.

15. The imaging system of claim 10, wherein the set of permanent magnets provides a clamping force against a surface of the external drum.

16. The imaging system of claim 10, wherein each aperture includes a circular area and an oval area.

17. The imaging system of claim 16, wherein the lift pads of an actuating system are configured to be inserted and removed through the circular area and displaced sideways into and out of the oval areas.

18. The imaging system of claim 10, wherein the cover comprises stainless steel.

19. The imaging system of claim 10, wherein the imaging system comprises a platesetter.

* * * * *